US005620230A

United States Patent [19]

Wu

[11] Patent Number: 5,620,230

[45] Date of Patent: Apr. 15, 1997

[54] ADJUSTABLE HAIRDRESSER'S CHAIR

[76] Inventor: Jung-Te Wu, No. 6, Lane 56, Woa-Tau Road, Dah-Li Shiang, Taichung, Taiwan

[21] Appl. No.: 535,860

[22] Filed: Sep. 28, 1995

[51] Int. Cl.[6] ..... A47C 15/00

[52] U.S. Cl. ..... 297/241; 74/89.15; 248/405; 297/257; 297/344.23

[58] Field of Search ..... 297/241, 240, 297/257, 344.2, 344.23, 344.12; 248/161, 405; 74/89.15

[56] References Cited

U.S. PATENT DOCUMENTS

| | | | |
|---|---|---|---|
| 4,527,976 | 7/1985 | Behringer et al. | 297/344.12 X |
| 4,863,217 | 9/1989 | Fountain | 297/241 |
| 5,222,710 | 6/1993 | White et al. | 248/405 X |
| 5,427,337 | 6/1995 | Biggs | 297/344.12 X |
| 5,437,495 | 8/1995 | Wu | 297/240 X |
| 5,496,090 | 3/1996 | Emmett et al. | 297/241 X |

*Primary Examiner*—Peter M. Cuomo
*Assistant Examiner*—Stephen Vu
*Attorney, Agent, or Firm*—Donald C. Casey, Esq.

[57] ABSTRACT

An adjustable hairdresser's chair is described. The chair includes a motor housing base which has a front shell and a rear shell interconnected by a bellows. A front seat is mounted on the front shell and a rear seat is mounted on the rear shell. The rear seat is vertically adjustable and horizontally adjustable relative to the front seat, while the front seat is horizontally rotatably adjustable, only. A first reversible drive controls the front seat unit. A second reversible drive vertically adjusts the rear seat unit and a third reversible drive controls the rear seat development relative to the front seat to change the distance therebetween.

3 Claims, 10 Drawing Sheets

ADJUSTABLE HAIRDRESSER'S CHAIR

BACKGROUND OF THE INVENTION

The present invention relates to an adjustable hairdresser's chair which has two seats for the client and the hairdresser and, which can be conveniently controlled to adjust the elevation of the seat for hairdresser, the angular position of the seat for client relative to the seat for hairdresser, and the distance between the seats.

Regular hairdresser's chairs commonly have only one seat for the client. Therefore, the hairdresser must stand up at one side while dressing or cutting the client's hair. If a chair is used for the hairdresser, it is inconvenient to frequently change the position or elevation of the chair. U.S. Pat. No. 5,437,495, which is an invention of the present inventor, discloses a flexible multi-direction beauty salon chair, in which the working chair of cosmetician or hair stylists can move in different directions through circuit control. However, this structure of beauty salon chair still has drawbacks. One drawback of this structure of beauty salon chair is that the transmission belt which transmit driving power from the motor to the working chair wears away quickly with use. Another drawback of this structure of beauty salon chair is that there is no safety means to prevent disengagement of the threaded rods from the respective ring gears during the adjusting of the chairs.

SUMMARY OF THE INVENTION

The present invention has been accomplished under the circumstances in view. It is one object of the present invention to provide an adjustable hairdresser's chair which has a seat for the client and a seat for the hairdresser. It is another object of the present invention to provide an adjustable hairdresser's chair which can be conveniently controlled to adjust the elevation of the seat for hairdresser, the angular position of the seat for client relative to the seat for hairdresser, and the distance between the seat for hairdresser and the seat for client. According to the present invention, the adjustable hairdresser's chair comprises motor housing base, which comprises a front shell, a rear shell, and a bellows covering linked between the front shell and the rear shell, a front seat unit mounted on the front shell, a rear seat unit mounted on the rear shell, a first reversible drive means controlled to turn the front seat unit, a second reversible drive means controlled to lift the rear seat unit, and a third reversible drive means controlled to move the rear shell relative to the front shell in changing the distance between the front seat unit and the rear seat unit.

DETAILED DESCRIPTION OF THE PREFERRED EMBODIMENT

Figure 1:
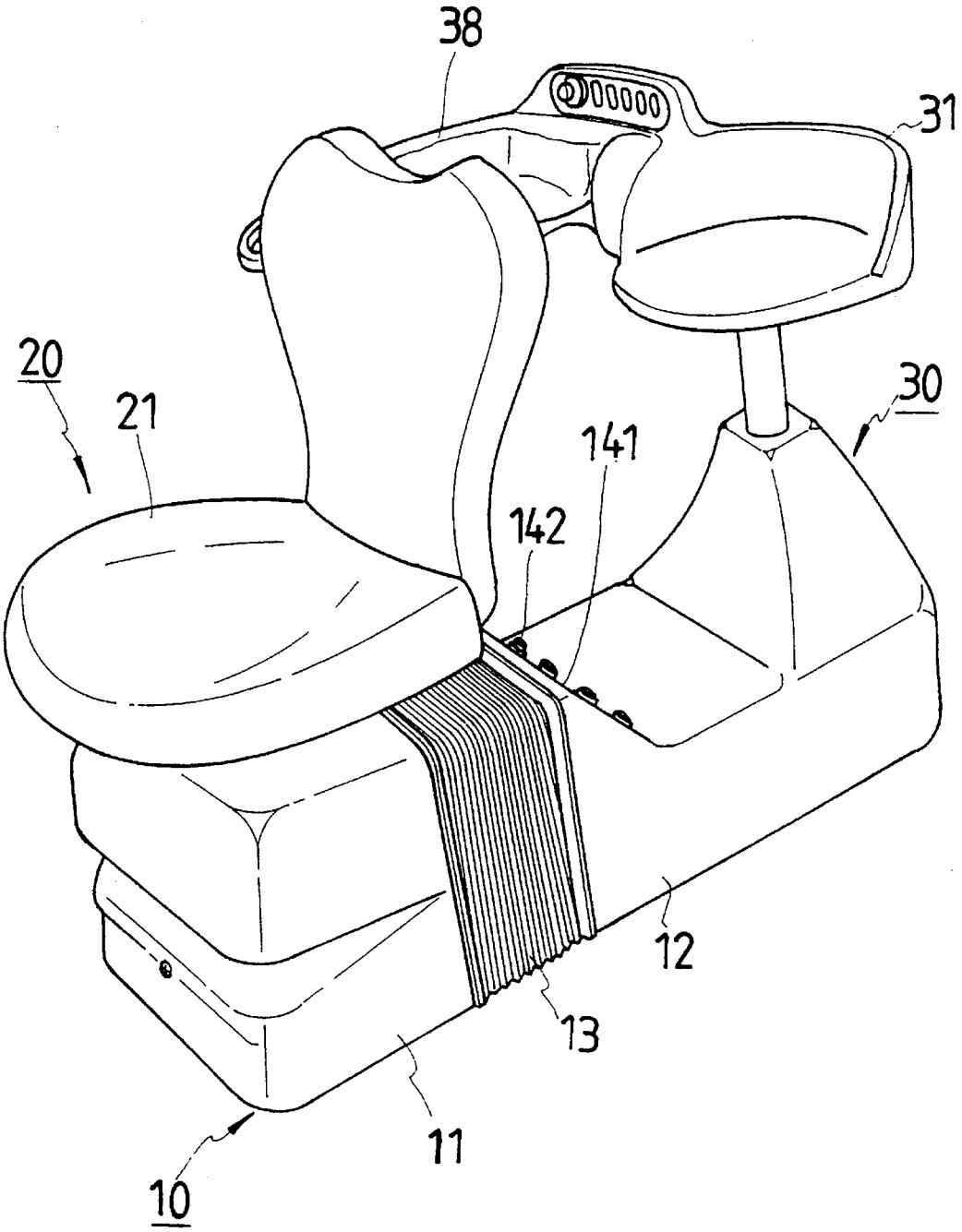
FIG. 1 is an elevational view of an adjustable hairdresser's chair according to the present invention.
Figure 2:
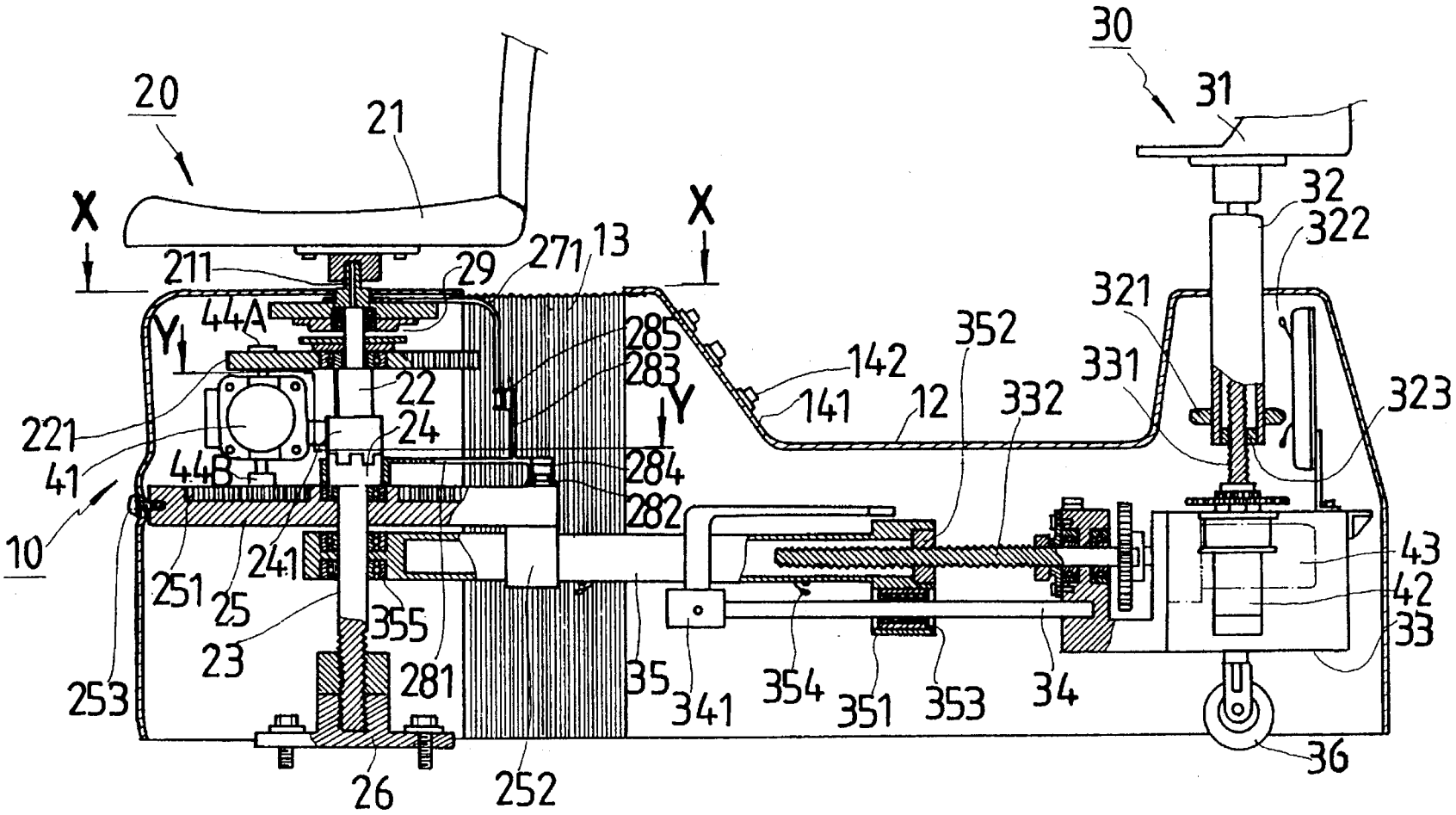
FIG. 2 is a side view in section of the adjustable hairdresser's chair shown in FIG. 1.
Figure 3:
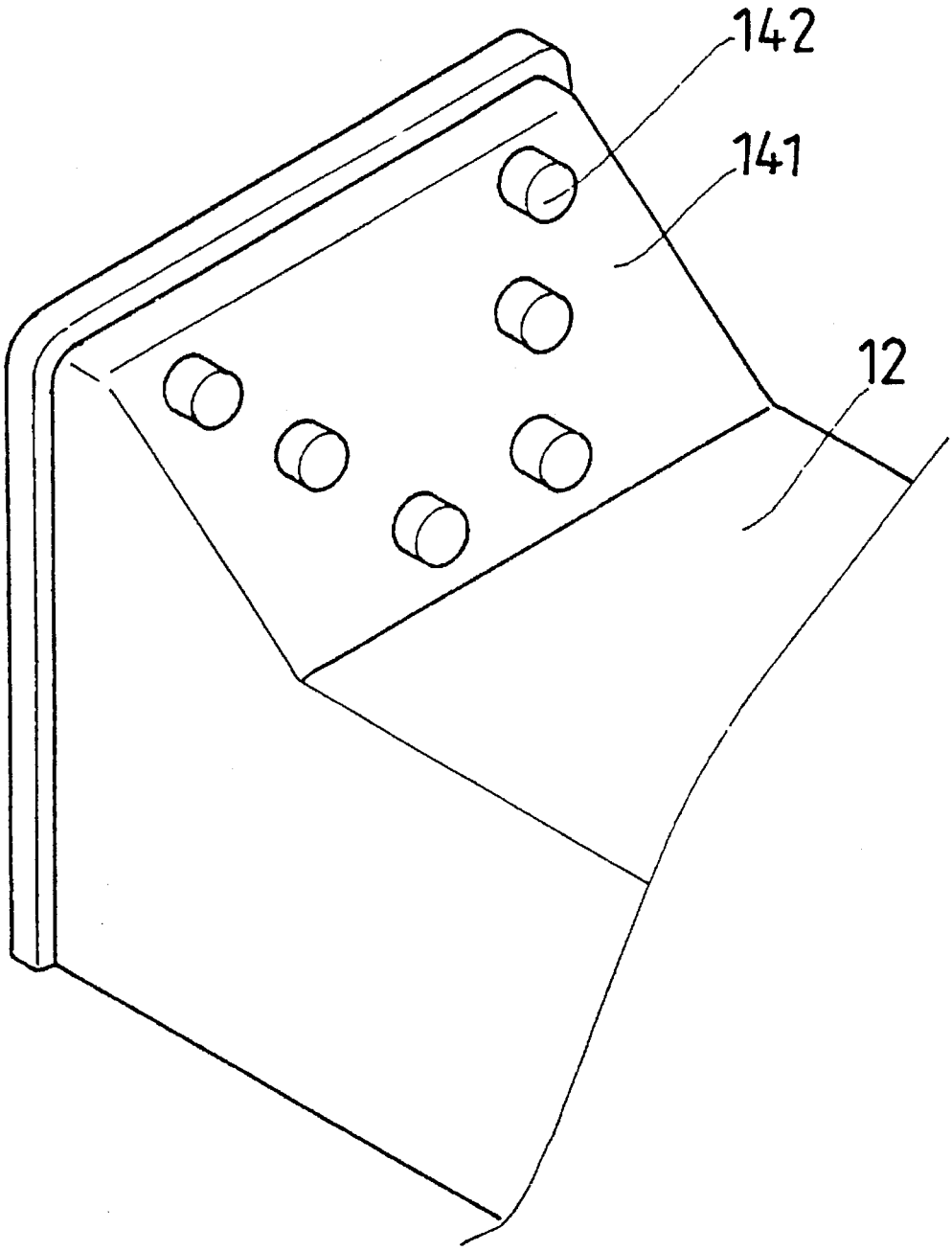
FIG. 3 shows the control unit and the control panel on the outside of the rear shell according to the present invention

Referring to FIGS. 1 and 2, an adjustable hairdresser's chair in accordance with the present invention is generally comprised of a motor housing base 10, a front seat unit 20, a rear seat unit 30, and a tray 38. The motor housing base 10 is comprised of a front shell 11, a rear shell 12, and a bellows covering 13 connected between the front shell 11 and the rear shell 12. The front seat unit 20 and the rear seat unit 30 are respectively mounted on the front shell 11 and the rear shell 12 and controlled to move by a control unit 142, which is mounted on an operating panel 141 fixed to the rear shell 12 at a suitable location conveniently for operation by foot.

Figure 4:
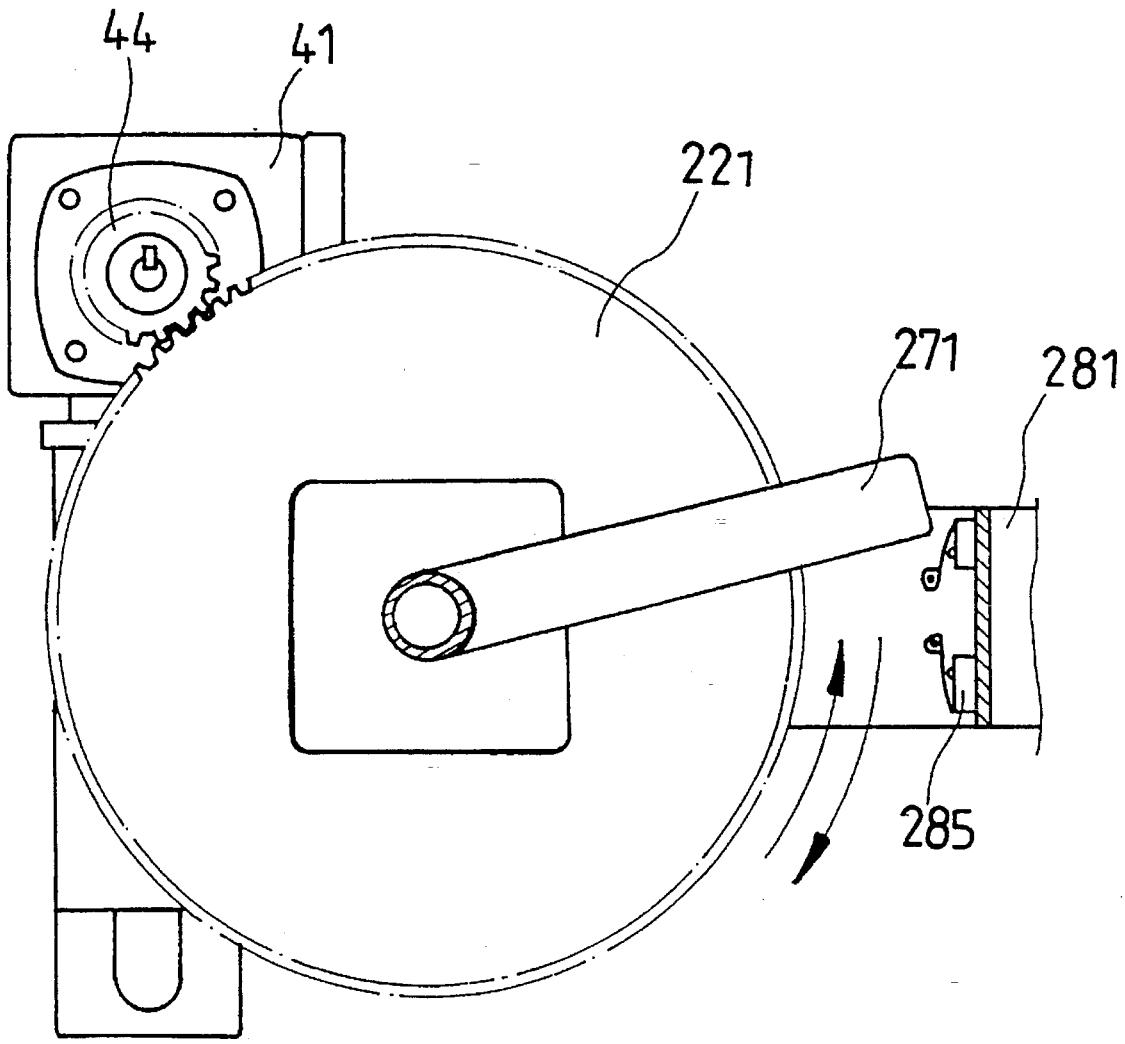
FIG. 4 is a sectional view in an enlarged scale taken along line X—X of FIG. 2.
Figure 5:
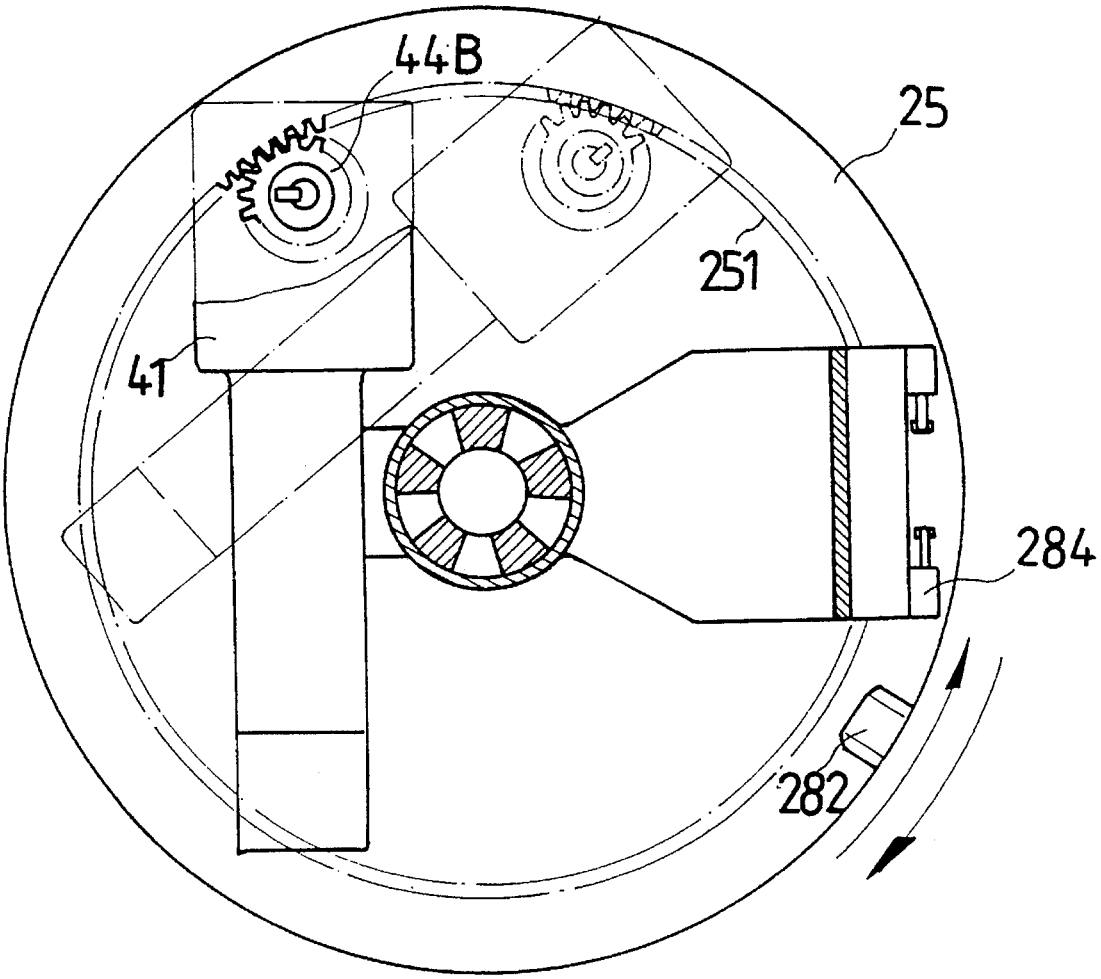
FIG. 5 is a sectional view in an enlarged scale taken along line Y—Y of FIG. 2.
Figure 6:
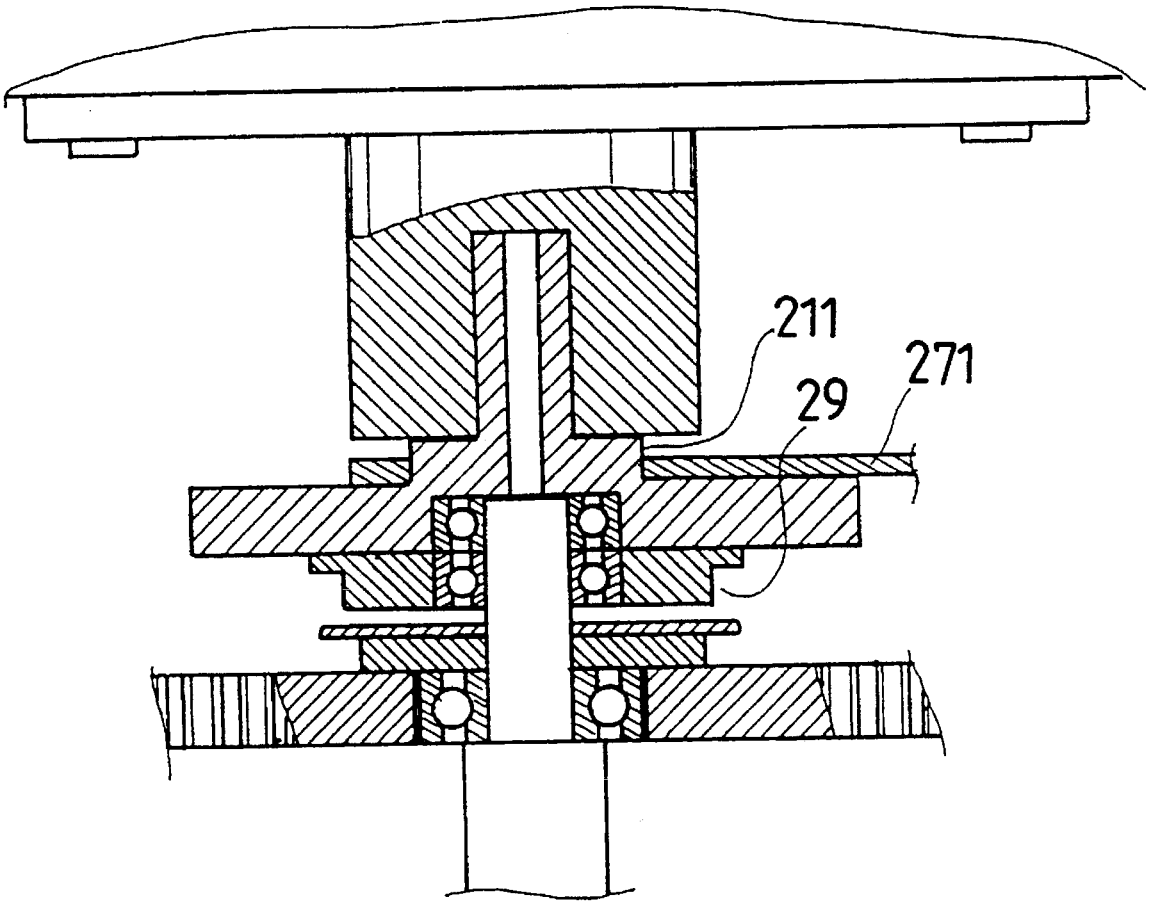
FIG. 6 is a sectional view showing the installation of the electromagnetic clutch on the front seat unit according to the present invention.
Figure 7A:
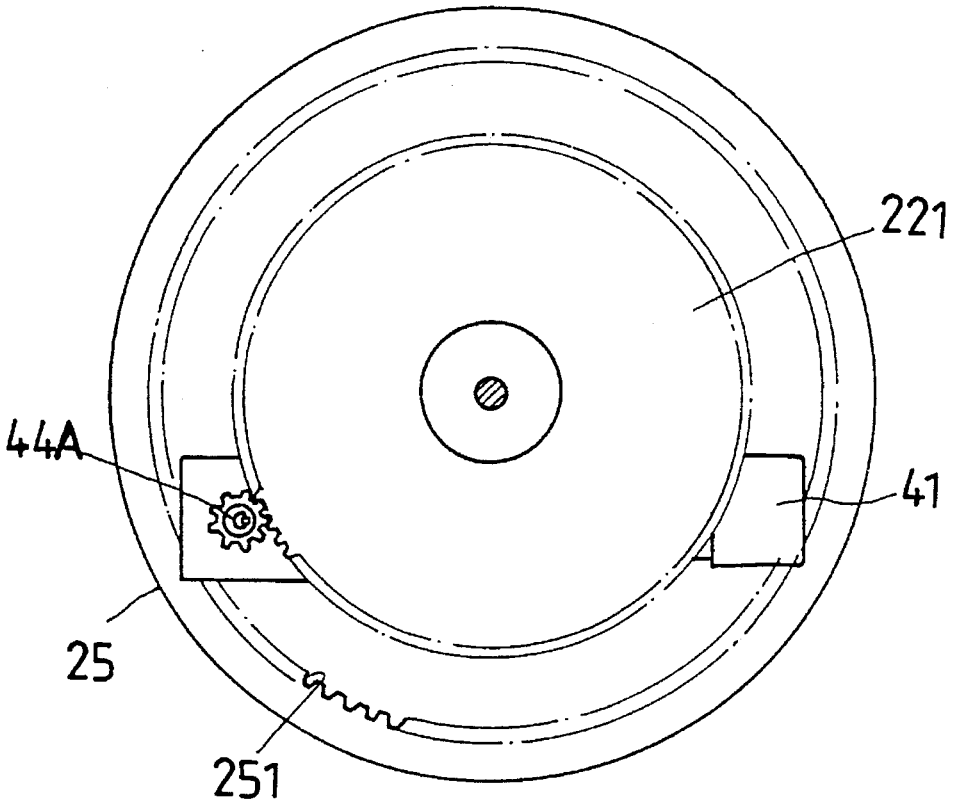
FIG. 7A is a top plain view showing the engagement between the pinion and the big gear according to the present invention.
Figure 7B:
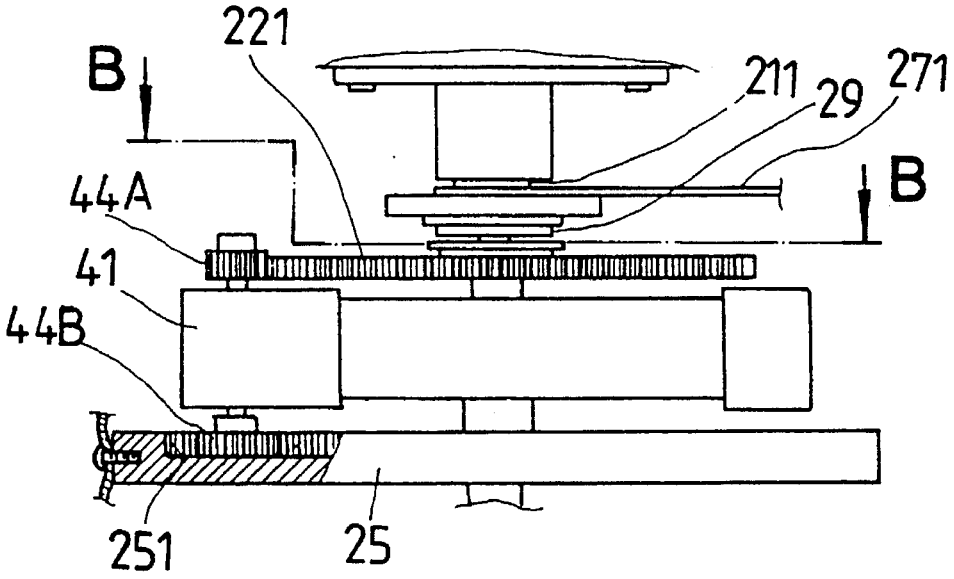
FIG. 7B is a side view in plain showing the installation of the transmission device in the front seat unit according to the present invention.

The front seat unit 20 comprises, a seat 21, a seat stem 211 having a top end coupled to the seat 21 and a bottom inserted through a hole (not shown) on the front shell 11 and coupled to an upper rod 22 through an electromagnetic clutch 29 (see also FIG. 6). The upper rod 22 has a bottom end terminating in a coupling portion 24 and 241 directly coupled to a bottom rod 23. The upper rod 22 is fixedly mounted with a big gear 221. The bottom rod 23 is fixedly mounted with transmission device 25. The transmission device 25 is fixedly secured to the front shell 11 on the inside by a screw 253, comprising an internal gear 251 fixedly mounted around the bottom rod 23 and coupled to the big gear 221 through first power drive 41. The first power transmission element 41 has a first pinion 44A at the top meshed with the big gear 221, and a second pinion 44B at the bottom meshed with the internal gear 251. The transmission device 25 further comprises a socket 252 for acting with a guide rod 35, and a contact block 282 at a suitable location. The bottom rod 23 is fixed mounted on an axle holder 26 inside the front shell 11 at the bottom, having a horizontal board 281 horizontally disposed at the top and an upright board 283 raised from the horizontal board 281. A micro switch 284 mounted on the projecting board 281 and controlled by the contact block 282 (see FIG. 5). A micro switch 285 is mounted on the upright board 283 controlled by a contact strip 271 on the stem 211 (see FIG. 4).

Figure 8A:
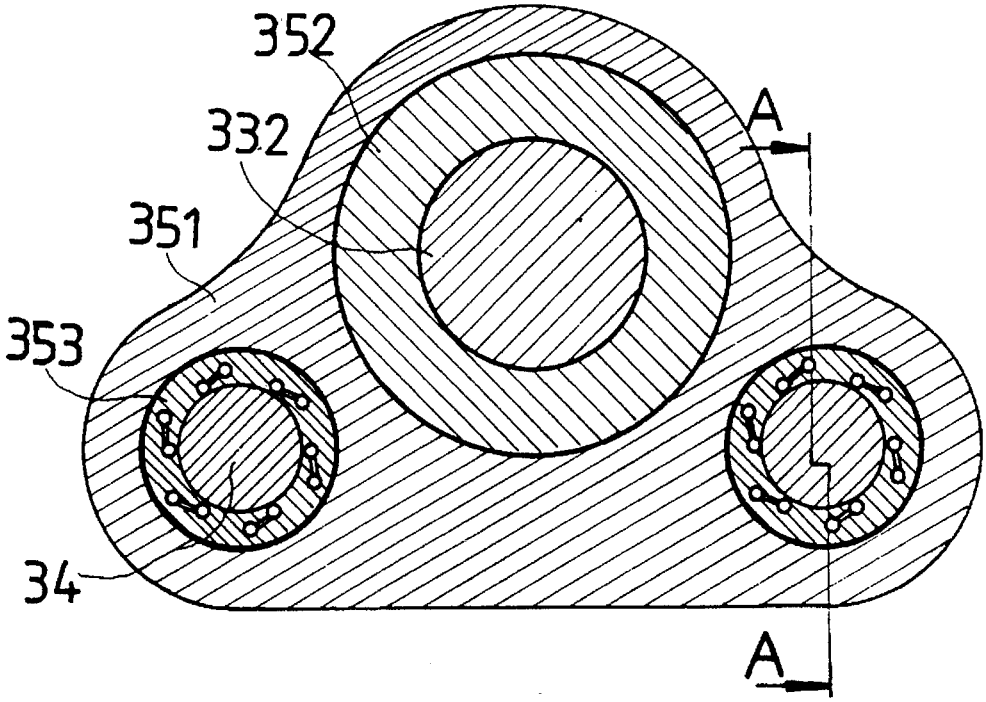
FIG. 8A is a cross sectional view of the bearing block according to the present invention.
Figure 8B:
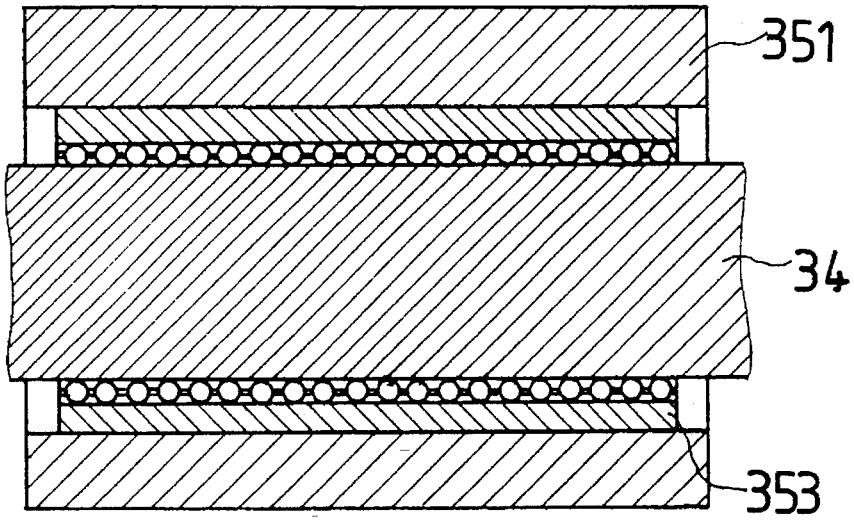
FIG. 8B is a side view in section showing the positioning of the rod in the bearing block according to the present invention.
Figure 10:
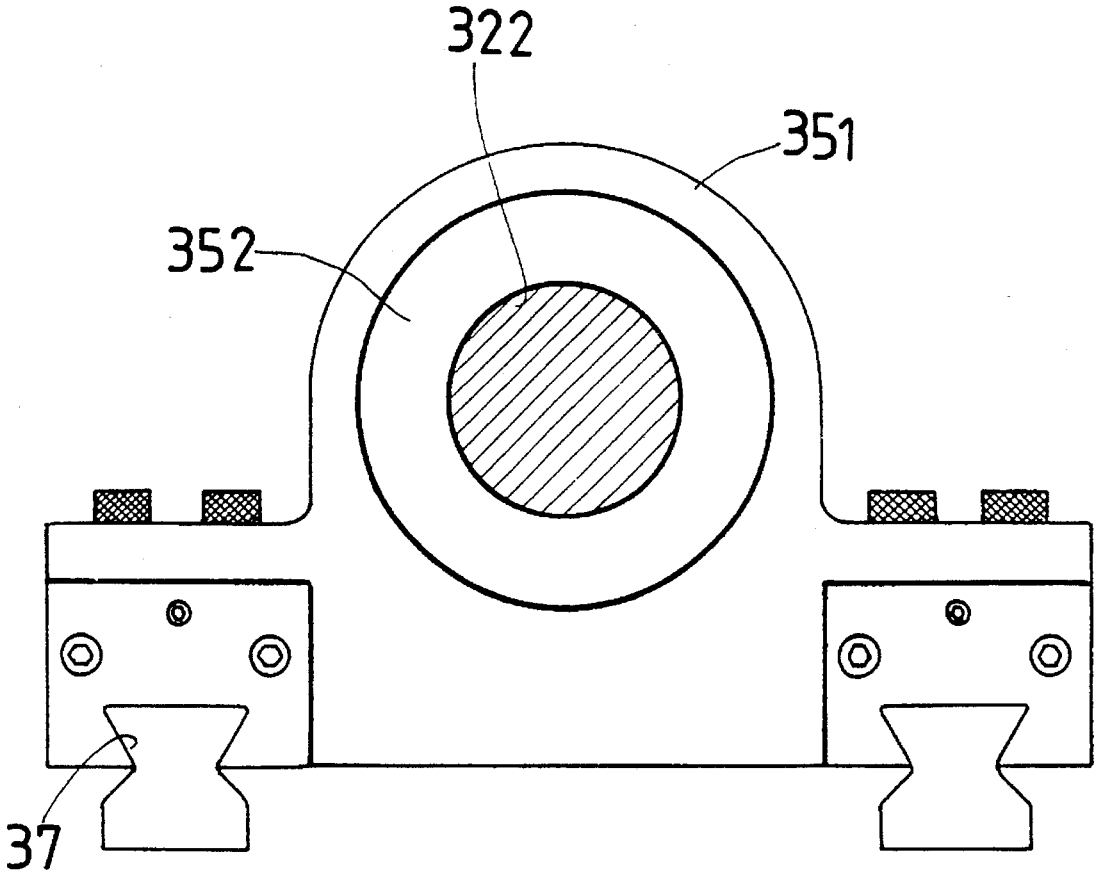
FIG. 10 shows an alternate form of the guide rod according to the present invention.

The rear seat unit 30 comprises a seat 31, an internally threaded upright seat tube 32 having a top end 323 fixedly coupled to the seat 31 and a bottom end threaded onto a first screw rod 331, which extends from a second power drive 42. When the first screw rod 331 is rotated, the seat 31 is turned upwards or downwards along the first screw rod 331. The upright seat tube 32 has a contact strip 321 moved between two micro switches 322 at different elevations. The micro switches 322 control the vertical moving distance of the seat 31. The second power drive 42 is mounted on a bearing block 33 inside the rear shell 12. A third power drive 43 is mounted on the bearing block 33 at right angles relative to the second power transmission element 42. The third power drive 43 is coupled to a flange 352 on the guide rod 35 by a second screw rod 332. The guide rod 35 is inserted through the socket 252, having a oblong slot 355 loosely coupled to the bottom rod 23. The aforesaid bearing block 33 is supported on a castor 36. When the third power drive 43 is moved, the bearing block 33 is forced to move the seat 31 forwards or backwards. The moving distance of the seat 31 is controlled by two opposite micro switches 354. The micro switches 354 are controlled by a block 341 at one end of a rod 34. The guide rod 35 comprises a bearing block 351 at one end. The bearing block 351 comprises a flange 352 and a bearing portion 353 respectively coupled to the second screw rod 232 and the rod 34 (see FIG. 8). Alternatively, the rod 34 and the bearing portion 353 may be made in the form of a sliding track 37 as shown in FIG. 10.

The transmission mechanism comprises the aforesaid first power drive 41, the second power drive 42, and the third power drive 43. The first power drive 41 drives the front seat unit 20 by the pinions 44A and 44B. The second and third power drives 42 and 43 drive the rear seat unit 30 through the screw rods 331 and 332.

Figure 9:
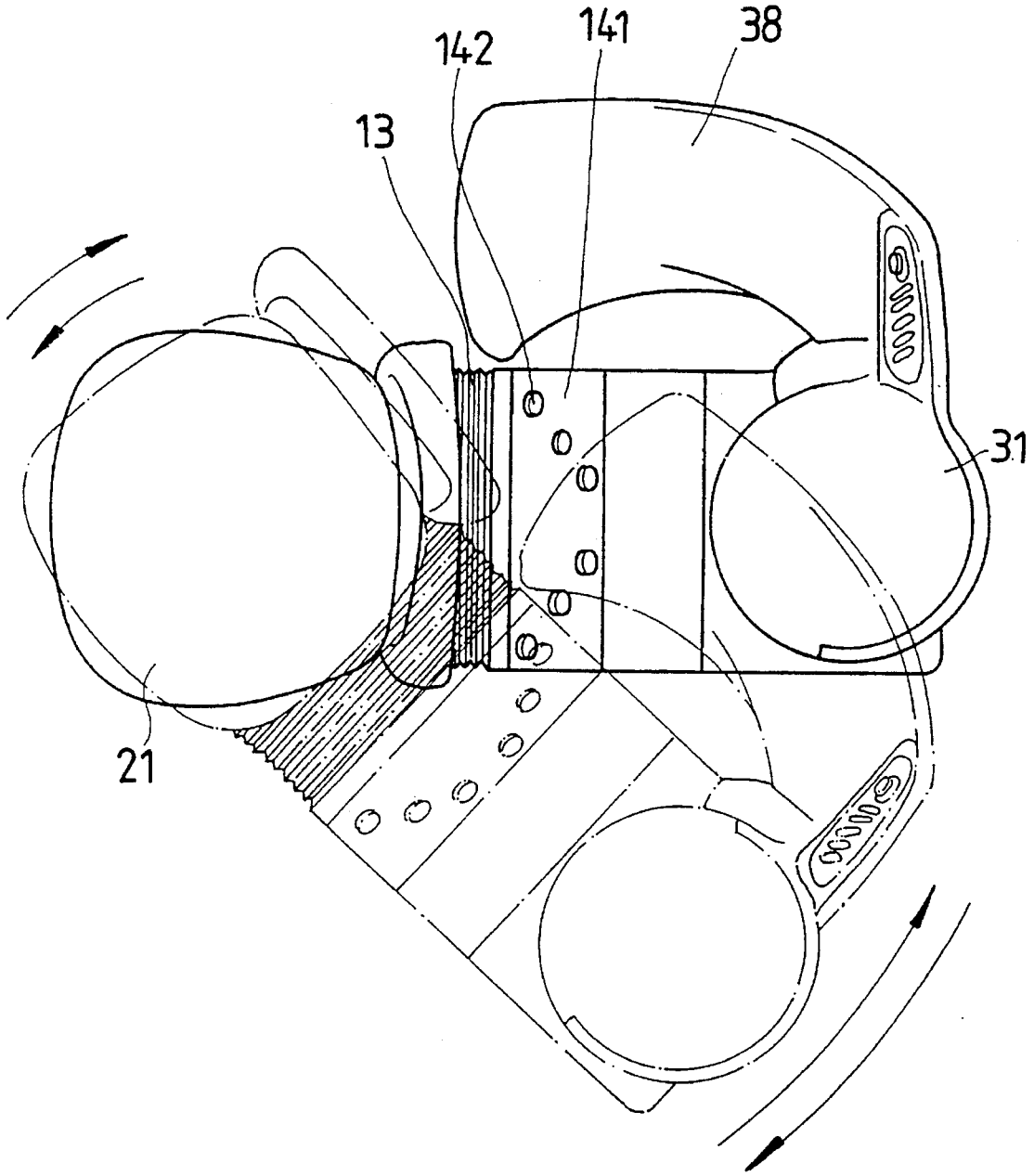
FIG. 9 shows the angular position of rear seat unit turned relative to the front seat unit according to the present invention.

By means of controlling the control unit 142 to drive the first reversible motor 41 and to simultaneously operate the electromagnetic clutch 29, the pinions 44A and 44B are respectively moved relative to the big gear 221 and the internal gear 251, causing the seat 21 turned (see FIG. 5) to the desired angle relative to the seat 31 (see FIG. 9). The micro switches 284 and 285 are controlled by the contact block 282 and the contact strip 271 of the transmission device 25 to limit the turning angle of the seat 21.

When to adjust the distance between the seat 21 of the front seat unit 20 and the seat 31 of the rear seat unit 30, the third power drive 43 is turned on to rotate the second screw rod 332, causing the bearing block 33 moved forwards or backwards. The block 341 of the rod 34 is moved by the second screw rod 332 between the micro switches 354 to control the moving distance of the rear seat unit 30 relative to the front seat unit 20.

When to adjust the elevation of the seat 31 of the rear seat unit 30, the second power drive 42 is driven to rotate the first screw rod 331, causing the upright seat tube 32 to lift or lower the seat 31. When the upright seat tube 32 is moved vertically, the contact strip 321 is carried by the upright seat tube 32 between the micro switches 322, which control the vertical moving distance of the upright seat tube 32.

It is to be understood that the drawings are designed for purposes of illustration only, and are not intended as a definition of the limits and scope of the invention disclosed.

I claim:

1. An adjustable hairdresser's chair comprising:

a motor housing base, said motor housing base comprising a front shell, a rear shell, a bellows covering linked between said front shell and said rear shell;

a front seat unit mounted on said front shell, said front seat unit comprising a seat stem, a seat supported on said seat stem, an upper rod fixedly secured to said seat stem, a bottom rod having a bottom end fixedly secured to an axle holder inside said front shell and a top end coupled to said upper rod;

a rear seat unit mounted on said rear shell, said rear seat unit comprising an internally threaded upright seat tube, a bearing block disposed inside said rear shell and supported on a castor, a screw rod mounted on said bearing block inside said rear seat and threaded into said upright seat tube and adapted to move said upright seat tube vertically;

first reversible drive means for rotating the seat stem of said front seat unit in changing the horizontal angle of the seat of said front seat unit relative to the seat of said rear seat unit, said first drive means comprising a first gear fixedly mounted around said upper rod of said front seat unit, and reversible motor controlled transmission mechanism coupled to said first gear;

second reversible drive means carried by the rear shell for rotating the screw rod of said rear seat unit and for changing the elevation of the seat of said rear seat unit;

third reversible drive means carried by said rear shell for moving said shell relative to said front shell to change the distance between the seat of said front seat unit and the seat of said rear seat unit, said third reversible drive means comprising a reversible motor mounted on said bearing block, a guide rod having a rear end coupled to the bottom rod of said front seat unit and a front end supported on a socket, a screw rod having one end coupled to said reversible motor and an opposite end threaded into a screw hole on a bearing at one end of said guide rod, the screw rod of said third reversible drive means being moved longitudinally relative to said guide rod to compress or expand said bellows covering when said reversible motor is activated;

a pair of first micro switches installed in said front shell adjacent said first drive means and a first contact block control means on said first drive means for limiting with said micro switches the turning angle of said seat stem of said front seat unit;

a pair of second micro switches installed in said rear shell adjacent said second drive means and a second block control means on said second drive means for limiting with said second micro switches the vertical movement of said upright seat tube of said rear seat unit;

a pair of third micro switches installed in said rear shell adjacent said third drive means and a third contact block control means on said third drive means for limiting with said third micro switches the horizontal movement of said rear shell relative to said front shell; and a control unit means mounted on said rear shell and having control keys for controlling said first drive means, said second drive means, and said third drive means.

2. The adjustable hairdresser's chair of claim 1 wherein said reversible motor-controlled transmission mechanism of said first reversible drive means comprises a reversible motor mounted on said upper rod of said front seat unit and having an output shaft and a first pinion and a second pinion at two opposite ends of said output shaft, said first pinion being coupled to said first gear, and a second gear fixedly mounted around said bottom rod of said first reversible drive means and coupled to said second pinion.

3. The adjustable hairdresser's char of claim 1 further comprising a rod slidably received through the bearing on said guide rod and having one end fixed to said bearing block and a control block coupled to an opposite end thereof said control block being moved by said hearing block between said pair of third micro switches.

* * * * *